United States Patent [19]

Ellis

[11] 4,270,283

[45] Jun. 2, 1981

[54] AIR RECYCLING APPARATUS FOR DRYING A TEXTILE WEB

[76] Inventor: James F. Ellis, P.O. Box 21160, Chattanooga, Tenn. 37421

[21] Appl. No.: 2,443

[22] Filed: Jan. 10, 1979

[51] Int. Cl.[3] ..... F26B 13/02; F26B 21/04

[52] U.S. Cl. ..... 34/212; 34/75; 34/216

[58] Field of Search ..... 34/210, 212, 215, 155, 34/216, 217, 75, 162; 165/107

[56] References Cited

U.S. PATENT DOCUMENTS

| | | | |
|---|---|---|---|
| 549,001 | 10/1895 | Mellen | 165/107 |
| 1,034,112 | 7/1912 | Hopkins | 34/216 X |
| 1,608,854 | 11/1926 | Haas | 34/215 X |
| 2,280,704 | 4/1942 | Hurxthal | 34/212 |
| 2,691,830 | 10/1954 | Karnofsky | 34/75 X |
| 3,743,474 | 7/1973 | Brock | 34/216 X |
| 3,849,904 | 11/1974 | Villalobos | 34/155 |
| 3,923,449 | 12/1975 | Brock | 34/155 X |
| 3,955,287 | 5/1976 | Brock et al. | 34/216 X |
| 4,148,600 | 4/1979 | Croft et al. | 34/155 X |

FOREIGN PATENT DOCUMENTS

| | | | |
|---|---|---|---|
| 926000 | 4/1955 | Fed. Rep. of Germany | 34/210 |
| 201770 | 1/1959 | Fed. Rep. of Germany | 34/216 |
| 2036248 | 12/1970 | France | 34/162 |
| 488968 | 2/1976 | U.S.S.R. | 34/212 |

*Primary Examiner*—Albert J. Makay
*Assistant Examiner*—Harold Joyce
*Attorney, Agent, or Firm*—Dunlap, Codding & McCarthy

[57] ABSTRACT

An apparatus and method for removing moisture from a porous textile web. The web is passed sequentially through a plurality of drying regions, dividing each of the drying regions into an upper drying zone and a lower drying zone. Air is drawn through the traveling web by variable speed fans disposed in the drying regions, the air forced by each of the fans into an air passageway having fluid communication with all of the upper drying zones and separated into air channels by divider panels. The fans are operable to maintain differential fluid pressure across the web in each of the drying zones, with the differential fluid pressure being greatest in the drying region last traversed by the web and decreasing at each of the drying regions upstream thereof so that the lowest differential fluid pressure is maintained in the first drying region, a portion of the air from each fan being caused to be recirculated to the upper drying zone above the respective fan and a portion of the air being passed to the upper drying zone of the respective adjacent upstream drying zone.

17 Claims, 4 Drawing Figures

AIR RECYCLING APPARATUS FOR DRYING A TEXTILE WEB

BACKGROUND OF INVENTION

1. Field of Invention

The present invention relates to the field of textile manufacturing, and more particularly but not by way of limitation, to equipment for the removal of moisture from textile products.

2. Discussion

In the manufacture of textile products, which are usually processed in long webs of varying widths, the textile material must be passed through a wash cycle to remove excess dye products and other accumulated substances, and following the wash cycle, the textile product must be dried. Numerous prior art devices have been operated with varying degrees of effectiveness, most of which have become near obsolete as the cost of energy has increased traumatically worldwide during the last few years. As energy has become more determinative of equipment function, different approaches to dryer designs have attempted to increase the operating efficiency while maintaining a reasonable balance of equipment investment.

Examples of recent prior art dryer designs may be found in the following patents: U.S. No. 3,955,287 subjects a carpet web to an initial high temperature air stream as the web enters the initial drying region, after which the carpet passes through another drying region that is maintained at a lower temperature; U.S. No. 3,743,474 subjects the entering carpet web to a high velocity of exhausting air, and as the web continues through the machine, low velocity heated air is recirculated through the web; and U.S. No. 3,849,904 passes a carpet web through a series of four chambers, paired such that the first and third chambers, and the second and fourth chambers, operate to force air down through the traveling web, and independent heat recovery systems operate to extract energy from the exhausted air.

SUMMARY OF INVENTION

The present invention provides an apparatus and method for removing entrained moisture from a porous carpet web wherein the web is passed through a plurality of housing assemblies defining an equal number of drying regions. The carpet web initially passes through a first drying region and then through each of the other drying regions in sequence, dividing each of the drying regions into an upper drying zone and into a lower drying zone. A plurality of air fans, one for each drying region, maintain differential fluid pressure across the traveling web between the upper and lower zones of each region to establish air flow through the web. Plural conduits interconnect the drying regions so that the air drawn from the lower zone of each drying zone is passed in part to the upper zone above said lower zone and in part to the upper zone of the respective adjacent upstream drying region by the maintenance of a lower differential fluid pressure in said adjacent upstream drying region. Plural heater units are disposed in selected ones of the drying zones for heating the air passing therethrough; an air inlet conduit permits external air entry only to the upper zone of the drying region last traversed by the traveling web; and an exhaust conduit withdraws air only from the first drying region traversed.

The exhausted air, in the preferred embodiment of the invention, is passed through a condenser apparatus in heat exchange relationship to a coolant fluid to cool the exhaust air and to remove moisture. The cooled and partially dried exhaust air is then passed as inlet air to the air inlet conduit; a portion of the exhaust air can be discharged to the atmosphere as required.

It is an object of the present invention to provide an apparatus and method for drying a porous textile product wherein maximum hot air contact is made with the textile product utilizing a minimum of equipment hardware.

Another object of the present invention, while achieving the above stated object, is to provide a dryer apparatus that maximizes the utilization of heating energy consumed by the apparatus.

Yet another object of the present invention, while achieving the above stated objects, is to provide a dryer apparatus of compact design that facilitates manufacturing, and minimizes operating and maintenance expense.

Other objects, features and advantages of the present invention will become apparent from a reading of the following detailed description of the preferred embodiment when considered with the included drawings and appended claims.

BRIEF DESCRIPTION OF DRAWINGS

FIG. 3 is a diagrammatical representation of the dryer apparatus of FIG. 1 shown in isometric, partially phantomized view.

DESCRIPTION OF INVENTION

Figure 1:
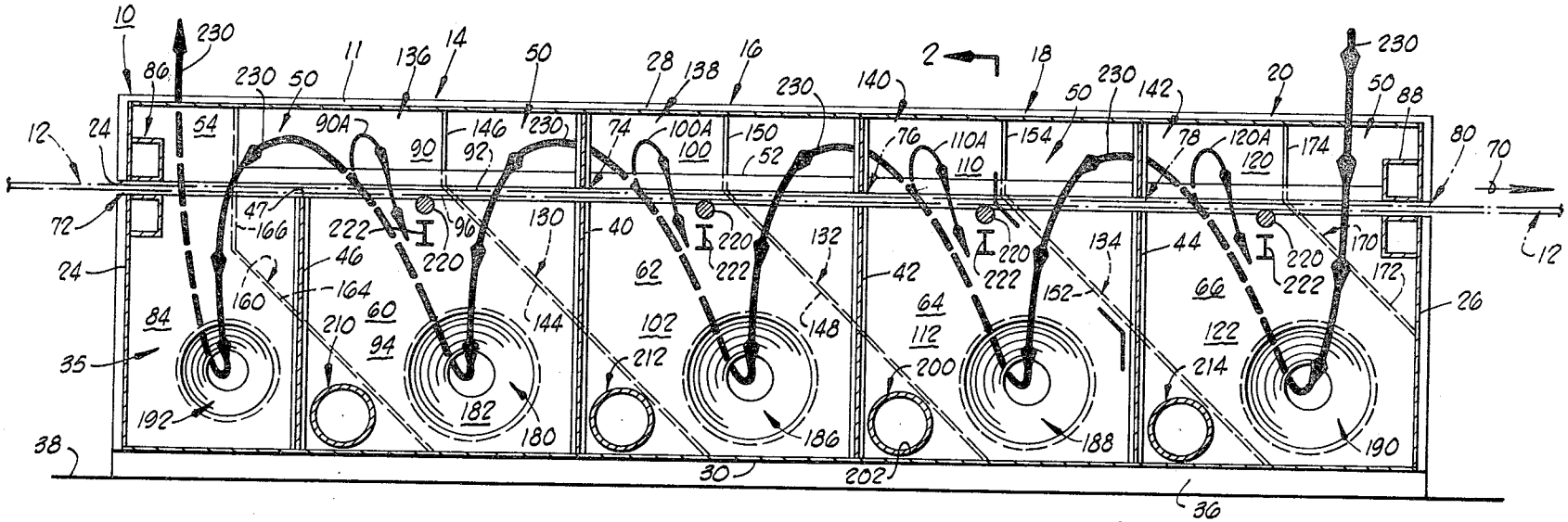
FIG. 1 is a semidetailed, side elevational view of a dryer apparatus constructed in accordance with the present invention.
Figure 2:
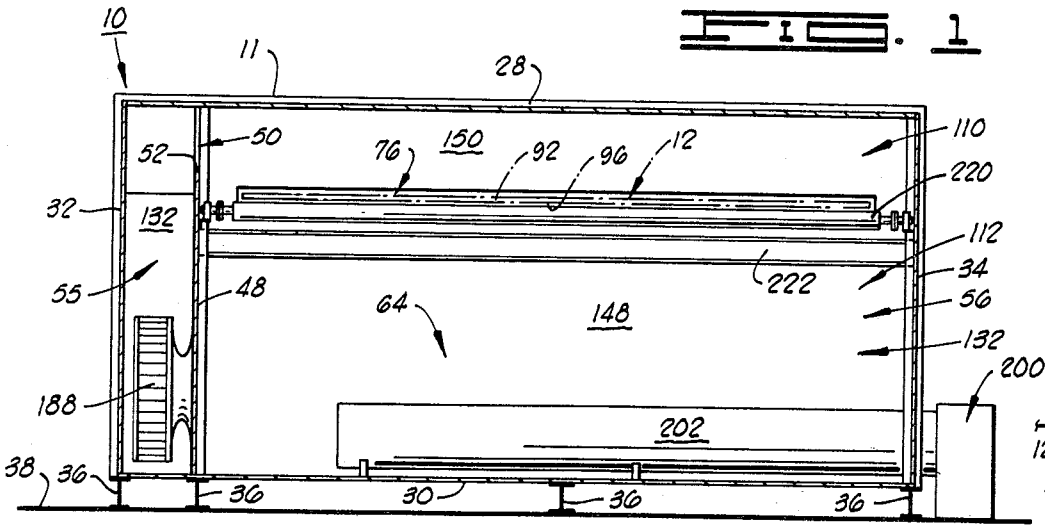
FIG. 2 is an elevation view taken at 2—2 in FIG. 1.

Referring to the figures generally, and particularly to FIGS. 1 and 2, shown therein and designated by the numeral 10 is a dryer apparatus constructed in accordance with the present invention. In FIG. 1, the dryer apparatus 10 is shown in semi-detail, side elevational view, and in FIG. 2, a sectional view of the dryer apparatus 10 is shown as taken along the line 2—2 in FIG. 1.

The dryer assembly 10 comprises a housing 11 that is in turn subdivided into a plurality of housing assemblies through which a web 12, representing a porous carpet or the like, passes sequentially. Each of the housing assemblies serves as an individual drying region, and for purposes of the present disclosure, the dryer apparatus 10 is depicted having a first housing assembly 14, a second housing assembly 16, a third housing assembly 18, and a fourth housing assembly 20. These drying assemblies will also be referred to hereinbelow as the first drying region 14, the second drying region 16, the third drying region 18 and the fourth drying region 20.

The drying apparatus 10 is constructed generally in the shape of an elongated, box-like housing member having a front wall 24 and a back wall 26; a top wall 28 and a bottom wall 30; and a first side wall 32 and a second side wall 34 (the side walls viewable in FIG. 2), all of which interconnect to form a generally sealed internal compartment 34. The bottom wall 30 is supported on a series of longitudinally extending I-beam members 36 which in turn are supported on a floor 38.

Internally, the internal compartment 34 is divided into the above-mentioned drying regions by a series of inner wall partitions. That is, a first wall partition 40 attaches to, and extends normal from, the second wall 34, and the wall partition 40 extends generally normal between, and attaches to, the top wall 28 and the bottom wall 30. Various means may be utilized for attaching the first wall partition 40 to the top, bottom and side walls 28, 34 and 30, respectively, such as by welding, and such attachment should provide a substantially airtight seal.

In like manner to that described for the first wall partition 40, a second wall partition 42 and a third wall partition 44 are attached to, and extend generally normal from, each of the top wall 28, the bottom wall 30 and the second side wall 34 in spaced apart, parallel relationship to each other and to the first wall partition 40. The partitions 40, 42 and 44 attach to a longitutinally extending internal wall member 48 that is supported by the housing 11 and disposed to extend from the front wall 24 to the back wall 26 between, and substantially parallel to, the first and second side walls 32, 34. The wall partitions 40, 42 and 44 are sealingly attached to the internal wall 48 (as by welding), and the ends of the internal wall 48 are sealingly attached to the front and back walls 24, 26. The internal wall 48 attaches to the bottom wall 30, and an air passageway 50 is formed between the top edge 52 of the internal wall member 48 and the top wall 28 of the housing 11.

Between the first wall partition 40 and the front wall 24, a baffle member 46 attaches to, and extends generally normal from, the bottom wall 30 in a generally parallel, spaced-apart relation to the first wall partition 40 and the front wall 24. The baffle member 46 extends between, and attaches to, the second side wall 34 and the internal wall member 48. The top edge 47 of the baffle member 46 is disposed just below the lower surface of the carpet 12 such that the carpet 12 passes closely to, but does not touch, the baffle member 46. Also, the internal wall member 48 has an extension portion 54 that extends to, and attaches to, the top wall 28 in the manner illustrated in the isometric, partially phantomized view of FIG. 3.

The above described arrangement of internal wall partitions in the housing 11 provides for the division of the internal compartment 34 into several compartments as follows: the internal wall member 48 divides the internal compartment 34 into an air passing compartment 55 on one side of the wall member 48 and into a drying chamber 56 on the other side of the wall member 48. The partitions 40, 42 and 44 serve to divide the drying chamber 55 into a first drying region 60, a second drying region 62, a third drying region 64 and a fourth drying region 66. The web 12, traveling in the direction indicated by the arrow 70, passes through a slot provided in each of the front and back walls 24, 26 and through slots provided in the inner wall partitions 40, 42 and 44. That is, the web 12 enters the housing 11 through a slot or web entry opening 72 provided in the front wall 24; the web 12 passes through the first drying region 60, and exits this drying region via a web opening 74 in the first wall partition 40; the web 12 passes through the second drying chamber 62 and exits this drying region via a web opening 76 in the second wall partition 42; the web 12 passes through the third drying region 64 and exits via a web opening 78 in the third wall partition 44; finally, the web 12 passes through the fourth drying chamber 66 and exits this drying chamber via a web exit opening 80 in the back wall 26.

The baffle member 46 is disposed to partition off the drying chamber 56 beneath the textile web 12 in the first drying chamber 60 to form an exhaust region 84 from which the dryer air finally exits from the drying chamber 56, as will be made clear below.

The web openings 74, 76 and 78, disposed respectively in the first wall partition 40, the second wall partition 42 and the third wall partition 44, are sized to freely pass a textile web, and conventional sealing curtains (not shown) may be disposed at these openings to minimize air passage therethrough. Also, conventional air curtain assemblies 86 and 88 (shown diagrammatically in FIG. 1) may be provided to minimize air escapement from the web entry opening 72 and the web exit opening 80 disposed respectively in the front wall 24 and the back wall 26.

The carpet web 12, in its passage through the housing 11, divides each of the drying regions into an upper (or first) zone and into a lower (or second) zone on opposing sides of the web 12. That is, the traveling web 12 divides the first dryer region 60 into an upper zone 90 on a first side 92 of the web 12, and into a lower zone 94 on a second side 96 of the web 12. Similarly, the web 12 divides the second dryer region 62 into an upper zone 100 and into a lower zone 102 on opposite sides of the web 12, the web 12 divides the third dryer region 64 into an upper zone 110 and into a lower zone 112 on opposite sides of the web 12; and the web 12 divides the fourth dryer region 66 into an upper zone 120 and into a lower zone 122 on opposite sides of the web 12. A discussion of the air flow in the dryer 10 is provided hereinbelow, and the reason for considering these upper and lower zones will be made clear.

Returning to the air passing compartment 55 mentioned hereinabove, and with reference especially to FIGS. 1 and 3, it will be noted that a plurality of divider panels are disposed within the compartment 55 in the following manner. A first divider panel 130, a second divider panel 132 and a third divider panel 134 are disposed to divide the air passing compartment 55 into a first air channel 136, a second air channel 138, a third air channel 140 and a fourth air channel 142. Each of the divider panels extends angularly from the bottom wall 30 to the top of the internal wall member 48 at which point each panel extends generally vertically to the top wall 28, and each divider panel extends between the internal wall member 48 and the first side wall 32; further, each wall panel is attached at points of contact with the bottom wall 30, the top wall 28, the internal wall 48 and the first side wall 32 via welding or the like to seal air flow except as directed in the above described air channels 136, 138, 140 and 142 in the manner described below.

The structure of the divider panels is as follows: the divider panel 130 has an angled portion 144 and a vertically extending member 146; the second divider panel 132 has an angled portion 148 and a vertical member 150; the third divider panel 134 has an angled portion 152 and a vertical portion 154. Additionally, an exhaust divider panel 160, similar to the other divider panels described, is disposed to form an exhaust conduit 162 near the front wall 24 as shown, and has an angled portion 164 and a vertical member 166. The vertical member 166 is connected to the vertically extending portion 54 of the internal wall member 48, and a hole 168 is provided in the top wall 28 for air escapement.

Finally, a divider panel 170, having an angled portion 172 and a vertical member 174, is provided near the back wall 26 as shown.

The above described arrangement of the divider panels, as mentioned, divides the air passing compartment 55 into several flow channels that have been enumerated as the air channels 136, 138, 140 and 142. These flow channels, respectively, communicate with the lower zone 94 of the first dryer region 60; the lower zone 102 of the second dryer region 62; the lower zone 112 of the third dryer region 64; and the lower region 122 of the fourth dryer region 66. It will be clear from FIGS. 1 and 3 that each of the air channels communicates with two of the upper zones of the drying regions, with the exception of the first air channel 136 that communicates with the upper zone 90, a space above the web 12 in the first dryer region 60 and above the exhaust region 84. As for the remaining air channels, the second air channel 138 communicates with the upper zone 90 (of the first drying region 60) and the upper zone 100 (of the second drying region 62); the third air channel 140 communicates with the upper zone 100 (of the second drying region 162) and with the upper zone 110 (of the third drying region 64); and the fourth air channel 142 communicates with the upper zone 110 (of the third drying region 64) and the upper zone 120 (of the fourth drying region 66).

The dryer apparatus 10 has a plurality of variable speed air blowers or fans equal in number to the number of drying regions. That is, each drying region has an air blower disposed to draw air through the web 12 passing therethrough and to discharge the air into its respective air channel. As shown in FIGS. 1 and 3, a first air blower 180 is supported by the internal wall member 48, having a nozzle portion 182 projecting through an aperture (not shown) in the wall 48 into the lower zone 94 of the first drying region 60. The blower 180 also has a discharge portion 184 disposed in the first air channel 136 of the air passing compartment 55. As for the other blower units mentioned hereinbelow, the air blower 180 is of the centrifical cage type in which air is drawn through the nozzle 182 and discharged peripherally from the discharge portion or rotating fan member 184.

In like manner to that which has been described for the first air blower 180, a second air blower 186 is disposed to draw air from the lower portion 102 (of the second drying region 62) and to discharge the air into the second air channel 138; a third air blower 188 is disposed to draw air from the lower portion 112 (of the third drying region 64) and to discharge the air into the third air channel 140; and a fourth air blower 190 is disposed to draw air from the lower portion 122 (of the fourth drying region 66) and to discharge the air into the fourth air channel 142. Another air blower 192, similar to the other air blowers described, is supported by the internal wall member 48 and positioned to draw air from the exhaust region 84 and to discharge the air into the exhaust conduits 162. The passage of air effected by the air blowers 180, 186, 188, 190 and 192 through the dryer apparatus 10 will be discussed hereinbelow.

As the air passes through the dryer 10, the air is heated by a plurality of heaters located in the lower zones of the drying regions. While any of several modes of heating may be employed, the dryer 10 is depicted with fuel burners as shown in FIG. 2, which shows a heater assembly 200 having a burner unit 202 extending through the second side wall 34 into the lower zone 112 of the third drying region 64. A blower unit 204 is located outside of the housing 11 and supported on the floor 38. Fuel supply lines are not shown. Similarly, heaters 210, 212 and 214 are disposed respectively in the lower zones of the first drying region 60, the second drying region 62 and the fourth drying region 66.

The dryer structure depicted as the dryer apparatus 10 shown in the Figures has been abbreviated in the interest of maintaining brevity and clarity of description herein. It will be understood that there are several features, such as electrical conduits, that need not be described, as such are conventional. It will be pointed out that certain structural details that have not been discussed hereinabove are shown in the drawings, such as the rollers 220 that are disposed at intervals along the path of the carpet web 12 in its passage through the housing 11; the rollers 220 may support an endless conveyor belt (not shown), the rollers 220 may be powered or free wheeling. The rollers 220 are conventional and are supported on structural members that connect to traversing I-beam members 222 that extend between and connect to the second side wall 34 and the internal wall member 48. Other structural members, such as stiffening members, may be employed as required in a conventional manner.

Another structural feature that has not been discussed is the air inlet conduit, which is represented in FIG. 3 as the hole 224 disposed in the top wall 28. The purpose of the hole 224 is to provide means for entering air to be admitted to the upper zone 120 of the fourth drying region 66. The passage of air through the housing 11 is depicted by the boldly marked arrow line 230, which represents the major path of air movement through the housing 11. The entering air is admitted to the drying housing through the hole 224 and passes fourth drying region 66. The air blower 190 maintains differential fluid pressure across the traveling carpet web 12 that divides the upper zone 120 from the lower zone 122, causing the entering air to be drawn through the carpet web 12 into the nozzle of the air blower 190 to be discharged into the fourth air channel 142 where the air is passed in a generally upward direction. A portion of the air discharged by the air blower 190 passes along the main air path 230 and enters the upper zone 100 of the third drying region 64. As the air reaches the top of the fourth air channel 142, it will be recognized that this air channel serves as a conduit means that interconnects between adjacent drying regions (in this case, the third and fourth drying regions 64 and 66) so that fluid communication is provided therebetween and air is passable from the lower zone of the upstream drying zone to the upper zone of the downstream drying zone that is adjacent thereto. However, it will also be recognized that the air channel 142 communicates with the upper zone above the fourth drying region from which the air has been taken, so that a portion of the air that is being discharged into the fourth air channel passes back to the upper zone 120 as depicted by the small arrow line 120A. As will become clear with the discussion of the operaton of the dryer apparatus 10 that is provided hereinbelow, the air blowers 180, 186, 188 and 190 are operated in a manner that causes the bulk air flow to follow the mass flow path indicated by the bold arrow line 230, but a considerable amount of recirculating air is created in each of the drying regions 60, 62, 64 and 66.

Continuing with a description of the air flow through the housing 11, the portion of air flowing from the fourth air channel 142 to the upper zone 110 is drawn through the carpet 12 by the third air blower 188 and discharged into the third air channel 140. A portion of the air flowing through the third air channel 140 follows the path indicated by the bold arrow line 230, while another portion of the air flows back to the upper zone 64 as indicated by the small arrow line 110A which represents air from the third air channel 140 recirculated through the traveling carpet web 12 in the third drying region 64. The air portion traveling from the third air channel 140 via the bold arrow line 240 is drawn through the carpet web 12 in the second drying region 62 via the second air blower 186 which discharges the air into the second air channel 138. Again, the air traveling through the second air channel 138 is divided into a portion that follows the bold arrow line 230 and into a portion that recirculates as depicted by the small arrow line 100A to be drawn through the carpet web 12 in the second drying region 62. The portion that travels along the bold arrow line 230 enters the upper zone 90 of the first dryer region 60 and is drawn through the carpet web 12 via the first air blower 180 which discharges the air into the first air channel 136.

A portion of the air passing through the first air channel 136 follows the bold arrow line 230 and discharges into the upper zone 90 at a point somewhat upstream to that of the discharge air stream coming to the upper zone 90 from the second air channel 136, and as denoted by the small arrow line 90A, another portion recirculates through the carpet web 12 to the lower zone 44 of the first drying region 60. The exhaust blower 192 draws the air along the bold arrow line 230 through the traveling carpet web and into the exhaust region 84 to discharge the air into the exhaust conduit 162 where the air is discharged from the housing 11 through the hole 168 in the top wall 28.

Figure 4:
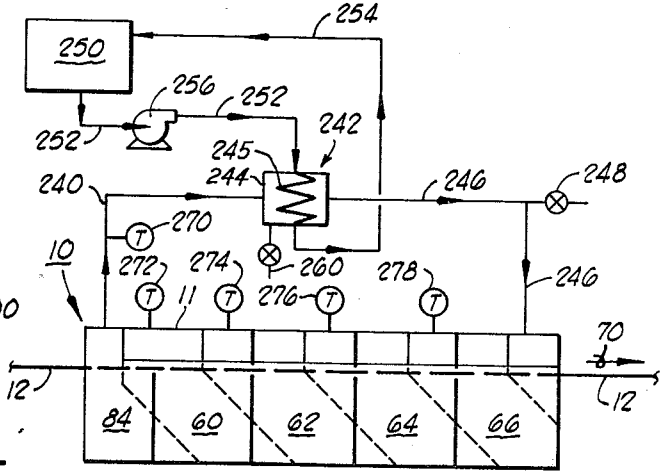
FIG. 4 is a diagrammatical representation of a heat recovery and exhaust air return system used in conjunction with the apparatus of FIG. 1.
Figure 9:
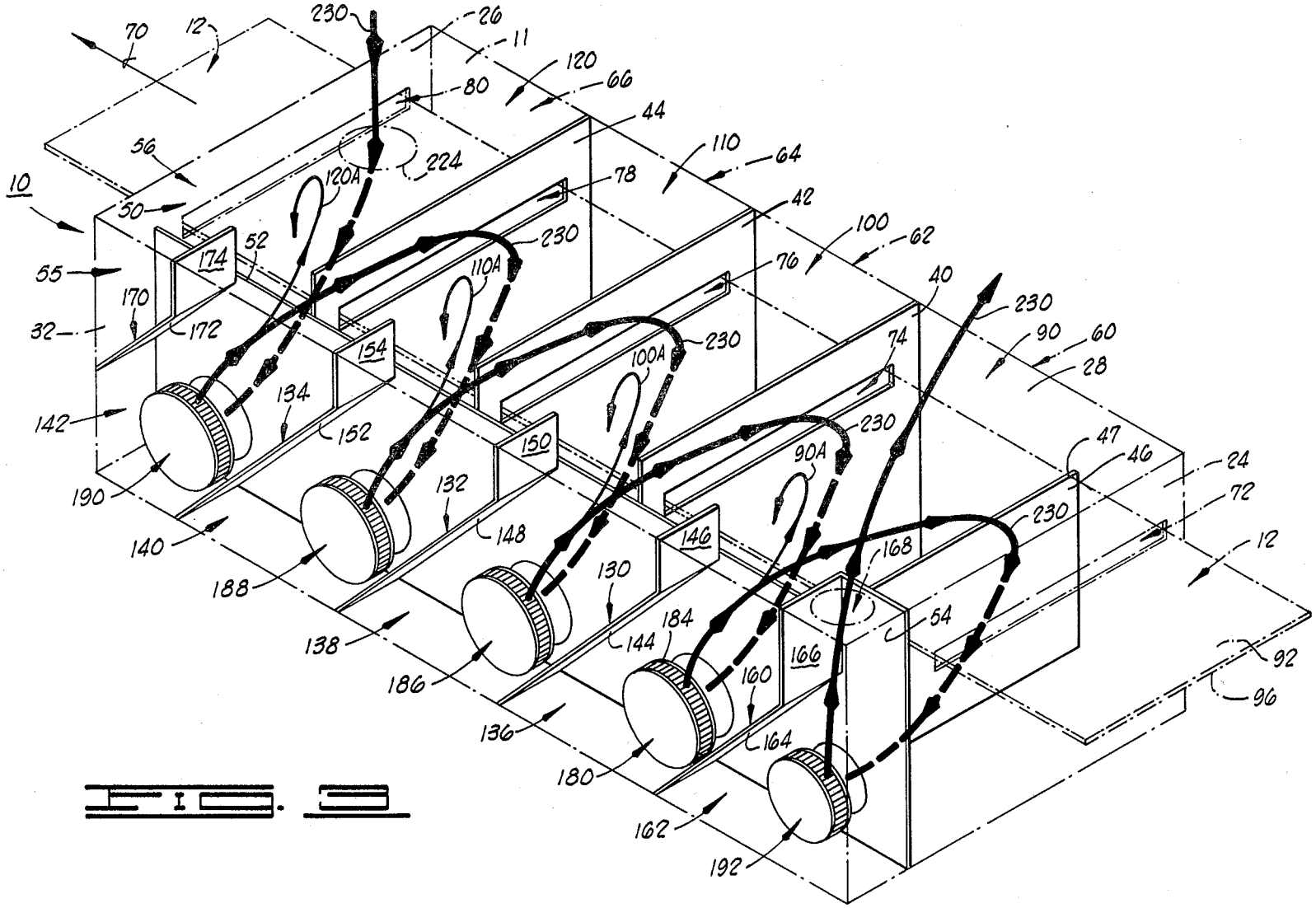

From the above description, it will be clear that the bold arrow line 230 represents the overall air flow through the dryer housing 11, while the recirculating air flow loops created in each drying region are depicted by the small arrow lines 120A, 110A, 100A and 90A. As the air passes through the housing 11, the air is heated via the heating assemblies 214, 200, 212 and 210 in order, and the moisture content of the air will increase as the air is passed through the dryer housing 11. Turning to FIG. 4, depicted therein is what happens to the air once it has been discharged from the housing 11.

FIG. 4 is a diagrammatical representation of the dryer apparatus 10 and its associated moisture removal equipment. An exhaust conduit 240 connects to the dryer housing 11 to receive air from the hole 168 in the top wall 28, the exhaust conduit 240 passing the air to a condenser 242. The condenser 242 has an outer jacket 244 and a heat exchanger coil 245 contained within the jacket 244. The air from the exhaust conduit 240 passes through the jacket 244 in heat exchange relationship to the heat exchanger 245 and enters an air inlet conduit 246. An air bleed valve 248 is provided to reduce the amount of air flowing in the air inlet conduit 246 that returns to the housing 11 to enter the hole 224 in the top wall 28 of the housing 11. The amount of air that is bled from the air inlet conduit 246 via the air bleed valve 248 will depend upon the type of heaters provided in the bottom of each of the drying regions 60, 62, 64 and 66. That is, in the case of fuel combustion in which combustion air is introduced into the drying regions, a build up in gas volume because of the products of combustion and the excess air introduced by the heater assemblies will occur, and the total volume of air and gas products recirculated through the dryer will remain constant in equilibrium conditions only by removing the excess of the air build up. Of course, there will be some leakage in the system, and this will mean that the air bleed valve 248 need remove only an amount necessary to maintain the proper air flow rate. In the event that steam or electrical heaters are used, it is possible that the air bleed valve will serve as an air make up valve to provide make up air equal to the amount of air lost by leakage. Additionally, it may be necessary under certain circumstances to provide air bleed off while at the same time providing fresh air make up to the heater 11 in those cases in which stoichiometric balances must be maintained when such factors as the products of combustion that are introduced in the system must be maintained below certain limits. For example, in an oil burner in which trace quantities of sulphur are present, a build up of detrimental acid in the air must be prevented, and it may be necessary to constantly remove a portion of the air and to make up a portion of the inlet air with fresh air.

Continuing with the diagrammatical representation of FIG. 4, a storage tank 250 is connected to a conduit 252 which connects to one end of the heat exchanger 245, and a return conduit 254 is connected between the other end of the heat exchanger 245 and the storage tank 250. A pump 256 is interposed in the conduit 252. The storage tank 252 holds a coolant fluid, such as a process water supply, and the coolant fluid is circulated via the pump 256 through the heat exchanger 245 so as to pass in heat exchange relationship with the air passing through the condenser jacket 244. The coolant fluid is thus heated and returned via the return conduit 254 to the storage tank 250. This arrangement serves to extract energy from the exhaust air exiting the housing 11 while cooling the exhaust air to condensate moisture therefrom in the condenser jacket, the moisture being removed therefrom as condensate via a moisture removal conduit 260. The cooled and dried air exiting the condenser jacket 244 is available for return to the housing assembly 11. In the event that air having less moisture is desired for return to the housing 11, conventional drying means, such as commercially available adsorbent units, may be employed.

The temperature of the air exhausted from the dryer housing 11 is measured by a conventional temperature measurement and indicating device 270 disposed in the exhaust conduit 240. The purpose of measuring and indicating the temperature of the exhaust air will become clear below when the method of operating the dryer 10 is discussed. Basically, although the speed or velocity control apparatus that controls the variable speed air blowers of the dryer 10 is not shown, the speed of the air blower 190 is determined in accordance with the information provided by an exhaust temperature measuring and indicating device 270, as the speed of this air blower is varied according to whether the temperature of the exhaust air from the dryer is at, or deviates from, a set point temperature determined by equilibrium conditions within the exhaust region 84. The exhaust temperature measuring and indicating device 270 may be a simple thermometer disposed in a thermometer well, or it may be a more elaborate device featuring multipen readout and recording.

In like manner to the exhaust temperature measuring and indicating device 270, similar devices are provided to measure and indicate the temperature of the air exiting each of the drying regions 60, 62, 64 and 66. That is, a first temperature measuring and indicating device 272 is disposed to measure and indicate the temperature of the air removed from the first drying region 60 via the first air blower 182; a second temperature measuring and indicating device 274 measures and indicates the temperature of the air removed from the second drying region 62 via the second air blower 186; a third temperature measuring and indicating device 276 measures and indicates the temperature of the air removed from the third drying region 64 via the third air blower 188; and a fourth temperature measuring and indicating device 278 measures and indicates the temperature of the air removed from the fourth drying region 66 via the fourth air blower 190.

For the purpose of discussing the operation of the dryer apparatus 10, reference will be made to "upstream" and "downstream" positions in the dryer apparatus. These terms refer to portions of the structure that are located relative to the entering and exiting locations of the carpet web 12. The carpet web 12 enters the dryer apparatus 10 via the web entry opening 72 disposed in the front wall 24, and the structure in FIG. 1 located to the reader's right of the opening 72 will be referred to as being downstream. In contrast, structure in FIG. 1 located to the reader's left of the web exit opening 80 will be referred to as being upstream.

Accordingly, air enters the dryer apparatus 10 downstream to the web entry opening 72 and bears a sinuous path from the fourth (or last) drying region 66 to the first drying region 60 before exhausting from the housing 11. The carpet web 12, on the other hand, enters the housing 11 at an upstream position via the web opening 78 in the front wall 24 and moves along a linear, countercurrent path relative to the air flow, the web supported by a conveyor or the like supported by the plural rollers 220. The path of the web 12 extends from the first drying region 60 to the fourth (or last) drying region 66 where the web exits the housing 11 via the web exit opening 80 in the back wall 26.

In this manner, the carpet web 12, passing through the several sequentially positioned drying regions in the dryer apparatus 10, divides each of the drying regions 60, 62, 64 and 66 into upper and lower drying zones on opposing sides of the web 12. The air enters upstream in the dryer apparatus 10 and moves downstream, passing through the carpet web 12 in each of the drying regions and becoming more saturated with moisture as it moves toward the downstream end of the dryer 10. The sinuous movement of the air through each of the drying regions 60, 62, 64 and 66 has been discussed, and mention need only be made that the air is heated in passing, in turn, through the lower zones 122, 112, 102 and 94 via the heaters 214, 200, 212 and 210, respectively, in the drying regions 66, 64, 62 and 60 as the air progresses downstream relative to the web 12.

In order to assure vigorous recirculation of the air in each of the drying regions, the air blower units 190, 188, 186 and 180 are operated at different fan velocities as follows. Referring to the differential pressure across the dynamic web in each drying region by its respective numerical designation, the pressure differential across the web 12 in the first drying region 60 will be designated the first differential fluid pressure; the pressure differential across the web 12 in the second drying region 62 will be designated the second differential fluid pressure; the pressure differential across the web 12 in the third drying region 64 wil be designated the third differential fluid pressure; and the pressure differential across the web 12 in the fourth drying region 66 will be designated the fourth differential fluid pressure.

In the operation of the dryer apparatus 10, the controls of the air blowers or fans 190, 188, 186 and 180 are set so as to establish a greater differential fluid pressure in the fourth (or last) drying region 66, with the value of the differential fluid pressure progressively becoming less with the drying regions located upstream relative to the fourth drying region 66. That is, the pressure drop effectuated in the drying regions increases with the drying regions located downstream (relative to the web 12) and decreases with the drying regions upstream (relative to the web 12); this progressively changing pressure drop across the web 12 is effected by operating the fourth air blower 190 at a faster air rate than the third air blower 188, which in turn is operated faster than the second air blower 186, and the second air blower 186 is operated faster than the first air blower 180, which is operated somewhat faster than the exhaust fan 192. Another way of considering this method of operation is to designate the ratio of the fan velocity of the fourth air blower 190 to the fan velocity of the third air blower 188 as $F_4$:$F_3$, the fan velocity of the third air blower 188 to the fan velocity of the second air blower 186 as $F_3$:$F_2$, and the fan velocity of the second air blower 186 to the fan velocity of the first air blower 180 as $F_2$:$F_1$. The velocities of the air blowers are established to make each of these ratios ($F_4$:$F_3$; $F_3$:$F_2$; and $F_2$:$F_1$) greater than one, which assures that a portion of air at each drying region will be recirculated along the air paths indicated by the arrow lines 120A, 110A and 100A. The operation of the exhaust air blower 192 is established such that the ratio $F_1$:$F_E$ is also slightly greater than one, thereby assuring recirculation along the air path indicated by the arrow line 90A.

As indicated above, the temperature measuring and indicating devices 270, 272, 274, 276 and 278 measure and indicate the temperatures, respectively, of the exhaust gasses leaving the housing 11, the air drawn from the first drying region 60, the air drawn from the second drying region 62, the air drawn from the third drying region 64 and the air drawn from the fourth drying region 66. In practice, each drying region will have a different temperature of air leaving that region because of the varying moisture content of the air and the effect of the heating of the air in each region. It is contemplated that a computer will receive signals indicating the conditions in each drying region, and that the conditions in each drying region will be independently monitored and varied, within the bounds, of course, of the fan velocity ratio restraints discussed above. The determination of the ratio of fan velocities between two adjacent drying regions will determine the quantity of air recirculated to the downstream (relative to the web 12) drying region. Whether by computer or by manual control, the following order is observed in operating the sequentially spaced drying regions comprising the dryer apparatus 10.

With experience on a particular type of carpet web, the equilibrium conditions existing in each drying zone can be calculated by performing heat and mass balance calculations on the dryer 10. From these calculations, conditions are set for each of the drying zones, and a known temperature and fan speed ratio is set. For a particular drying region, the temperature of the air leaving that region is compared to the established or set temperature, and if a variation is observed, the heater in that particular drying region is adjusted within the range of the heater capability to effect a change in the temperature of the leaving air. If the air temperature yet deviates from the set temperature after changing the heater to the limits of its capability, the air flow rate in the drying region is adjusted within determined ranges of fan velocities acceptable within the restraints of establishing the fan velocity ratios as discussed above. If, after the fan velocity has been adjusted within the limits of the fan capability, there is still a deviation between the leaving air temperature and the set temperature, the linear speed of the carpet is changed to a carpet speed that brings the temperature back to the set point.

This process of monitoring the temperature of the air is performed for each of the drying regions 60, 62, 64 and 66, and it will be recognized that the changes effected in one drying region will have a bearing on the conditions in the other drying region. Accordingly, it is recommended that monitoring of the air temperatures and varying the conditions of the drying regions be performed in a sequential manner. That is, it is suggested that the changes be performed as necessary for the conditions in the fourth drying region 66, immediately following which the conditions are monitored in the third drying region 64 and the necessary changes are accomplished; immediately following this, the conditions prevailing in the second drying region 62 should be monitored and necessary changes made accordingly; and immediately following these changes, the conditions in the first drying region 60 should be monitored and changes made accordingly. Finally, the conditions should be monitored in the exhaust region 84 and changes made accordingly in this region. Having performed this monitoring process for each of the drying regions 60, 62, 64 and 66, and for the exhaust region 84, in sequence, attention once again is directed to the fourth drying region 66 and the monitoring process is again performed in sequence. Once equilibrium conditions are established, little or no changes will be required. With computer monitoring, the changes will be made more rapidly and in continuous sequence.

Once the air exits the housing assembly 11 the air is passed via the exhaust conduit 240 to the moisture removal assembly represented by the condenser 242 and associated equipment. The exhausted air is passed through the condenser jacket 244 in heat exchange relationship to the heat exchanger 245. The coolant contained in the storage tank 250 is circulated via the pump 256 through the heat exchanger 245 and back to the storage tank 250 via the conduit 254. This arrangement serves to collect and accumulate a substantial portion of the heat energy contained in the exhaust gas leaving the housing assembly 11, and the storage tank 250 represents a source of energy available for other unit operations of a carpet mill or the like. As the exhaust air is passed in heat exchange relationship to the heat exchanger 245, moisture is condensed from the air and is removed from the condenser jacket 244 via the moisture removal conduit 260. The cooled air exits the condenser jacket 244 via the conduit 246, and the air bleed valve 248 removes a selected portion of the air before the air is passed back to the housing assembly 11 to enter the hole 224. As mentioned above, the air bleed valve 248 may not be necessary when products of combustion are not added to the air flowing through the housing assembly 11.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. An air recycling dryer apparatus for removing entrained moisture from a porous carpet web, the dryer apparatus comprising:

a first housing assembly defining a first drying region, the first housing assembly having a carpet web entry opening and a carpet web exit opening such that the carpet web can travel through the first drying region of the first housing assembly, the carpet web traveling through the first housing assembly dividing the first drying region into a first zone on a first side of the carpet web and into a second zone on a second side of the carpet web;

a second housing assembly defining a second drying region, the second housing assembly having a carpet web entry opening and a carpet web exit opening such that the carpet web exiting the first drying region of the first housing assembly can travel through the second drying region of the second housing assembly, the carpet web traveling through the second housing assembly dividing the second drying region into a first zone on the first side of the carpet web and into a second zone on the second side of the carpet web;

first air means for maintaining a differential fluid pressure across the carpet web between the first and second zones of the first drying region of the first housing assembly to establish air flow through the carpet web traveling through the first drying region;

second air means for maintaining a differential fluid pressure across the carpet web between the first and second zones of the second drying region of the second housing assembly to establish air flow through the carpet web traveling through the second drying region;

first air flow channel means interconnecting the first and second housing assemblies such that the second zone of the second drying region of the second housing assembly is in fluid communication with the first zone of the first drying region, the first air flow channel dividing the air flow from the second air means such that a portion of the air flow in the second housing assembly is passed to the first zone of the first housing assembly and a portion of the air flow of the second air means passes through the carpet web traveling through the second drying region of the second housing assembly;

first heater means for heating the air in the second drying region;

air inlet means providing fluid communication to the first zone of the second drying region for supplying inlet air thereto; and exhaust conduit means providing fluid communication from the second zone of the first drying region for exhausting air therefrom.

2. The apparatus of claim 1 wherein the second air means is operative to maintain a greater differential fluid pressure across the carpet web in the second drying region than is maintained by the first air means across the carpet web in the first drying region so that the rate of air flow from the second air means is greater than the rate of air flow from the first air means and a major portion of the air from the second zone of the second region is passed via the first air flow channel means to the first zone of the first drying region.

3. The apparatus of claim 2 further comprising:

moisture removal means connected to the exhaust conduit means for condensing and removing moisture from air removed from the second zone of the first drying region.

4. The apparatus of claim 3 wherein the air inlet means is connected to the moisture removal means for receiving the air passing therefrom.

5. The apparatus of claim 4 wherein the moisture removal means is characterized as comprising a condenser having a heat exchanger and a condenser jacket, and the apparatus further comprises:

storage tank means for holding a suppoly of coolant fluid; and means connected to the heat exchanger for circulating the coolant fluid between the storage tank means and the heat exchanger such that the coolant fluid circulating through the heat exchanger is in a heat exchange relationship with the air passing through the condenser jacket.

6. The apparatus of claim 4 or claim 5 wherein the air inlet means comprises:

air bleed means for bleeding a portion of the air from the moisture removal means, the remaining portion of the air passing through the moisture removal means and being directed as inlet air to the first zone of the second drying region.

7. An air recycling dryer apparatus for drying a porous carpet web, comprising:

a plurality of housing assemblies defining an equal number of drying regions, each of the housing assemblies having a carpet web entry opening and a carpet web exit opening such that the carpet web can travel through the housing assemblies, the carpet web initially passed through a first drying region and then through each of said other drying regions in sequence, the travelling carpet web dividing each of the drying regions into an upper zone and a lower zone;

air means disposed in each of the drying regions for maintaining differential fluid pressure across the traveling carpet web between the upper and lower zones of each drying region to establish air flow through the carpet web traveling through each of the drying regions;

air flow channel means interconnecting each of the housing assemblies to the adjacent upstream housing assembly for providing fluid communication therebetween so that air is passable from the lower zone to the upper zone of each drying region of each housing assembly, and to the upper zone of the adjacent upstream drying region of the adjacent upstream housing assembly;

a plurality of heater means disposed in a selected number of the drying regions of the housing assemblies for heating the air passing through the drying regions;

air inlet means providing fluid communication to the upper zone of the downstream drying region last traversed by the traveling carpet web for supplying inlet air thereto; and exhaust conduit means providing fluid communication with the lower zone of the first drying region for exhausting air therefrom.

wherein each of the air means downstream to the first drying region is operative to maintain a greater differential fluid pressure across the carpet web than is maintained in the adjacent upstream drying region so that the air caused to flow through the traveling carpet in each of the housing assemblies downstream of the first of the housing assemblies is divided by the air flow channel means such that a major portion of the air is passed to the upper zone of the drying region of the adjacent upstream housing assembly and the remaining portion of the air is passed to the upper portion of the drying region of the housing assembly.

8. The apparatus of claim 7 further comprising:

moisture removal means connected to the exhaust conduit means for condensing and removing moisture from air removed from the first drying region.

9. The apparatus of claim 8 wherein the air inlet means is connected to the moisture removal means for receiving the air passed therefrom.

10. The apparatus of claim 9 wherein the dryer means is characterized as comprising a condenser having a heat exchanger and condenser jacket, and the apparatus further comprises:

storage tank means for holding a supply of coolant fluid; and means connected to the heat exchanger for circulating the coolant fluid between the storage tank means and the heat exchanger such that the coolant fluid circulating through the heat exchanger is in a heat exchange relationship with the air passing through the moisture removal means.

11. The apparatus of claims 9 or 10 wherein the air inlet means comprises:

air bleed means for bleeding a portion of the air from the moisture removal means, the remaining portion of the air from the moisture removal means being directed as inlet air to the upper zone of the downstream drying region last traversed by the traveling carpet web.

12. A dryer apparatus for removing moisture from a porous carpet web, comprising:

a substantially enclosed housing comprising a front wall, a back wall, a pair of substantially parallel side walls and a top wall defining an internal compartment, the front wall having a web entry opening and the back wall having a web exit opening;

a longitudinally extending internal wall member supported by the housing and disposed to extend from the front wall to the back wall between and substantially parallel to the side walls, the internal wall member dividing the internal compartment into an air passing compartment on one side of the internal wall member and into a drying chamber on the other side of the internal wall member, there being an air passageway between the top of the internal wall member and the top wall of the housing so that fluid communication is established between the drying chamber and the air passing compartment;

first partition means supported by the housing for dividing a portion of the drying chamber into a first drying region through which the carpet web initially passes;

second partition means supported by the housing for dividing the remaining portion of the drying chamber into at least a second drying region and into a third drying region, the carpet web initially passing through the first drying region and then sequentially through the second and third drying regions, the traveling carpet web dividing each of the drying regions into an upper zone on a first side of the web and into a lower zone on an opposite second side of the web;

first air means for maintaining a first differential fluid pressure across the carpet web between the upper zone and lower zone of the first region and for forcing air drawn through the carpet web from said lower zone into the air passing compartment;

exhaust conduit means for receiving air from the first air means and for exhausting said air;

second air means for maintaining a second differential fluid pressure across the carpet web between the upper zone and the lower zone of the second region and for forcing air drawn through the carpet web from said lower zone into the air passing compartment;

first divider means disposed in the air passing compartment for separating the air from the second air means from the air from the first air means and for directing the air from the second air means to the air passageway above the internal wall member, the first partition means cooperating with the first divider means to divide said air such that a portion of the air passes into the upper zone of the second drying region and another portion of the air passes to the upper zone of the first drying region, the first and second air means operative to maintain the second differential fluid pressure at a greater value than the first differential fluid pressure;

third air means for maintaining a third differential fluid pressure across the carpet web between the upper zone and the lower zone of the third region and for forcing air drawn through the carpet web from said lower zone into the air passing compartment;

second divider means disposed in the air passing compartment for separating the air from the third air means from the air from the second air means and for directing the air from third air means to the air passageway above the internal wall member, the second partition means cooperating with the second divider means to divide said air such that a portion of the air passes to the upper zone of the third drying region and another portion of the air passes to the upper zone of the second drying region, the second and third air means operative to maintain the third differential fluid pressure at a greater value than the second differential fluid pressure;

air inlet means providing fluid communication to the upper zone of the third region for supplying inlet air thereto;

first region heater means supported by the housing in the lower zone of the second drying region for heating the air and carpet web passing therethrough;

second region heater means supported by the housing in the lower zone of the second drying region for heating the air and carpet web passing therethrough; and third region heater means supported by the housing in the lower zone of the third drying region for heating the air and carpet web passing therethrough.

13. The apparatus of claim 12 further comprising:

moisture removal means connected to the exhaust conduit means for condensing and removing moisture from the air passed from the first air means.

14. The apparatus of claim 13 wherein the air inlet means receives air from the moisture removal means.

15. The apparatus of claim 14 wherein the moisture removal means is characterized as comprising a condenser having a heat exchanger and condenser jacket, and the apparatus further comprises:

storage tank means for holding a supply of coolant fluid; and means connected to the heat exchanger for circulating the coolant fluid between the storage tank means and the heat exchanger such that the coolant fluid circulating through the heat exchanger is in a heat exchange relationship with the air passing from the moisture removal means.

16. The apparatus of claim 12 or 13 wherein the air inlet means comprises:

air bleed means for bleeding a portion of the air from the moisture removal means, the remaining portion of air from the moisture removal means being directed as inlet air to the upper zone of the third drying region.

17. The apparatus of claims 12, 13, 14 or 15 further comprising:

conveyor means for supporting and moving the carpet web along a predetermined path within the housing from the web entry opening to the web exit opening.

* * * * *

UNITED STATES PATENT AND TRADEMARK OFFICE

CERTIFICATE OF CORRECTION

PATENT NO. : 4,270,283

DATED : June 2, 1981

INVENTOR(S) : James F. Ellis

It is certified that error appears in the above—identified patent and that said Letters Patent is hereby corrected as shown below:

Column 6, line 35, after the word "passes" insert --into the upper zone 120 of the--.

Column 6, line 44, the number "100" should be --110--.

Column 13, line 19, the word "suppoly" should be --supply--.

Signed and Sealed this

*Twentieth* Day of *April 1982*

[SEAL]

*Attest:*

GERALD J. MOSSINGHOFF

*Attesting Officer*

*Commissioner of Patents and Trademarks*